US009705238B2

(12) United States Patent
Osada et al.

(10) Patent No.: US 9,705,238 B2
(45) Date of Patent: Jul. 11, 2017

(54) WATERPROOF CONNECTOR AND FABRICATING METHOD THEREFOR

(71) Applicant: Yazaki Corporation, Tokyo (JP)

(72) Inventors: Tatsuo Osada, Kakegawa (JP); Shogo Suzuki, Makinohara (JP); Masayuki Saitoh, Makinohara (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 14/955,197

(22) Filed: Dec. 1, 2015

(65) Prior Publication Data

US 2016/0156125 A1 Jun. 2, 2016

(30) Foreign Application Priority Data

Dec. 2, 2014 (JP) ..... 2014-244241

(51) Int. Cl.
*H01R 13/405* (2006.01)
*H01R 13/52* (2006.01)
*H01R 43/00* (2006.01)

(52) U.S. Cl.
CPC ..... *H01R 13/5216* (2013.01); *H01R 13/521* (2013.01); *H01R 43/005* (2013.01); *Y10S 439/936* (2013.01)

(58) Field of Classification Search
CPC ..... H01R 13/521; Y10S 439/936
USPC ..... 439/736, 936
See application file for complete search history.

(56) References Cited

U.S. PATENT DOCUMENTS 3,522,575 A * 8/1970 Fitch ..... H01J 5/32 174/153 R
5,433,628 A * 7/1995 Sadaishi ..... H01R 4/64 29/883
7,070,449 B2 * 7/2006 Miyazaki ..... H01R 9/032 439/272
7,682,204 B2 * 3/2010 Tokairin ..... H01R 13/405 29/858
2006/0281372 A1 * 12/2006 Mott ..... H01R 13/04 439/736

FOREIGN PATENT DOCUMENTS

JP 4-324323 A 11/1992
JP 6-84565 A 3/1994
JP 9-7672 A 1/1997
JP 2012-134130 A 7/2012

OTHER PUBLICATIONS

Communication dated Nov. 14, 2016, issued by the Japanese Patent Office in counterpart Japanese Patent Application No. 2014-244241.

* cited by examiner

*Primary Examiner* — Tho D Ta
(74) *Attorney, Agent, or Firm* — Sughrue Mion, PLLC

(57) ABSTRACT

A waterproof connector includes a resin housing; a conductor extended from the resin housing, and provided with a recess portion at a portion of a part embedded in the resin housing; and a sealing agent interposed in a gap between the conductor which includes the recess portion and the resin housing.

10 Claims, 6 Drawing Sheets

WATERPROOF CONNECTOR AND FABRICATING METHOD THEREFOR

CROSS REFERENCE TO RELATED APPLICATION

This application is based on Japanese Patent Application (No. 2014-244241) filed on Dec. 2, 2014, the contents of which are incorporated herein by reference. Also, all the references cited herein are incorporated as a whole.

BACKGROUND OF THE INVENTION

1. Technical Field

One or more embodiments of the present invention relate to a waterproof connector and more particularly to a technique for enhancing the waterproofness of a waterproof connector which is formed by insert molding a conductor in a housing.

2. Background Art

There is known a connector in which a metallic conductor is insert molded in a resin housing. However, in this type of molded product, for example, the volume of the housing is greatly reduced due to the contraction of the resin after molding, and therefore, a minute gap may be produced between the conductor and the housing. In case the connector in which the gap is produced in the way described above is exposed to an environment which contains water, water may intrude into the housing through the gap in the surface of the conductor.

To cope with this, Patent Literature 1 discloses a technique in which a connector in which a conductor is insert molded in a housing is placed in a closed container where a liquid sealing agent is stored to thereby be submerged in the liquid sealing agent so that the gap between the conductor and the housing is filled with the sealing agent by varying the pressure inside the container. The sealing agent which is filled in the gap in this way volatilizes and solidifies whereby the gap is sealed.

Patent Literature 1 is JP-A-2012-134130.

SUMMARY OF THE INVENTION

Incidentally, the liquid sealing agent which is filled in the gap between the conductor and the housing adheres to the surface of the conductor by the surface tension of the conductor. However, as illustrated in FIG. 6, in the case that a shape of a cross section of a conductor 52 which is embedded in a housing 51 (a shape of a cross section perpendicular to an extending direction of the conductor 52) is rectangular, almost no sealing agent 53 is allowed to adhere to four corner portions 54 of the conductor 52.

Because of this, minute craps 55 defined between the conductor 52 and the housing 51 near the corner portions 54 cannot be filled with the sealing agent 53, and water may intrude into the housing 51 via the gaps 55 in the four corners.

One or more embodiments of the invention have been made in view of these situations, and a problem to be solved by the embodiments is to enhance the sealing performance of a gap between a conductor which is insert molded in a housing and the housing.

A waterproof connector of the embodiments of the invention made to solve the problem has a resin housing; a conductor extended from the resin housing, and provided with a recess portion at a portion of a part embedded in the resin housing; and a sealing agent interposed in a gap between the conductor which includes the recess portion and the resin housing.

According to the waterproof connector described above, the sealing agent applied to the conductor before it is molded is retained within the recess portion by the surface tension, and therefore, the adhering amount of the sealing agent per unit area on the surface of the conductor is increased, whereby the sealing agent adheres to the surfaces of corner portions of the conductor. Additionally, the sealing agent which has adhered to the corner portions of the conductor remains on the surface of the corner portions of the conductor even after the sealing agent has solidified. Consequently, in case that the conductor on which the sealing agent has solidified is insert molded in the housing, the sealing agent can be interposed between gaps between the corner portions of the conductor and the housing, and therefore, the sealing performance of sealing the gaps between the conductor and the housing can be enhanced.

In this case, a cross section of the conductor may be in a rectangular shape, the cross section perpendicular to an extending direction of the conductor, and the recess portion may be a notched portion in a plane including at least one side of the cross section.

According to the waterproof connector which configured in the way described above, the sealing agent which is retained in the notched portion can be pushed out to the corner portions when the conductor is insert molded, and therefore, the thickness of the sealing agent in the corner portions is increased, thereby making it possible to enhance the sealing performance. As this occurs, it is preferable that the notched portion is formed on each of planes (four planes) including the respective sides of the cross section.

Specifically, the conductor may include one end portion in an interior of the resin housing, the other end portion which is in an exterior of the resin housing and to be fixed to an exterior portion, and a fixing portion which is connected to the one end portion and the other end portion and is embedded in the resin housing, and the recess portion may be formed in the fixing portion.

In addition, the waterproof connector which is configured as has been described heretofore can be fabricated by applying the sealing agent to the conductor in the part embedded in the resin housing; and insert molding the conductor in the resin housing after the sealing agent has solidified.

According to the embodiments of the invention, the sealing performance of sealing the gap between the conductor which is insert molded in the housing and the housing can be enhanced.

BRIEF DESCRIPTION OF THE DRAWINGS

FIGS. 4A and 4B illustrate a fixing portion of a related-art conductor, of which FIG. 4A is a partial enlarged view of the fixing portion and FIG. 4B is a sectional view illustrating a state in which a sealing agent adheres to the fixing portion before molding.

FIGS. 5A and 5B illustrate a fixing portion of the conductor of the waterproof earth joint connector to which the embodiment of the invention is applied, of which FIG. 5A is a partial enlarged view of the fixing portion, and FIG. 5B is a sectional view illustrating a state in which a sealing agent adheres to the fixing portion before molding.

DETAILED DESCRIPTION OF THE EXEMPLARY EMBODIMENTS

Figure 1:
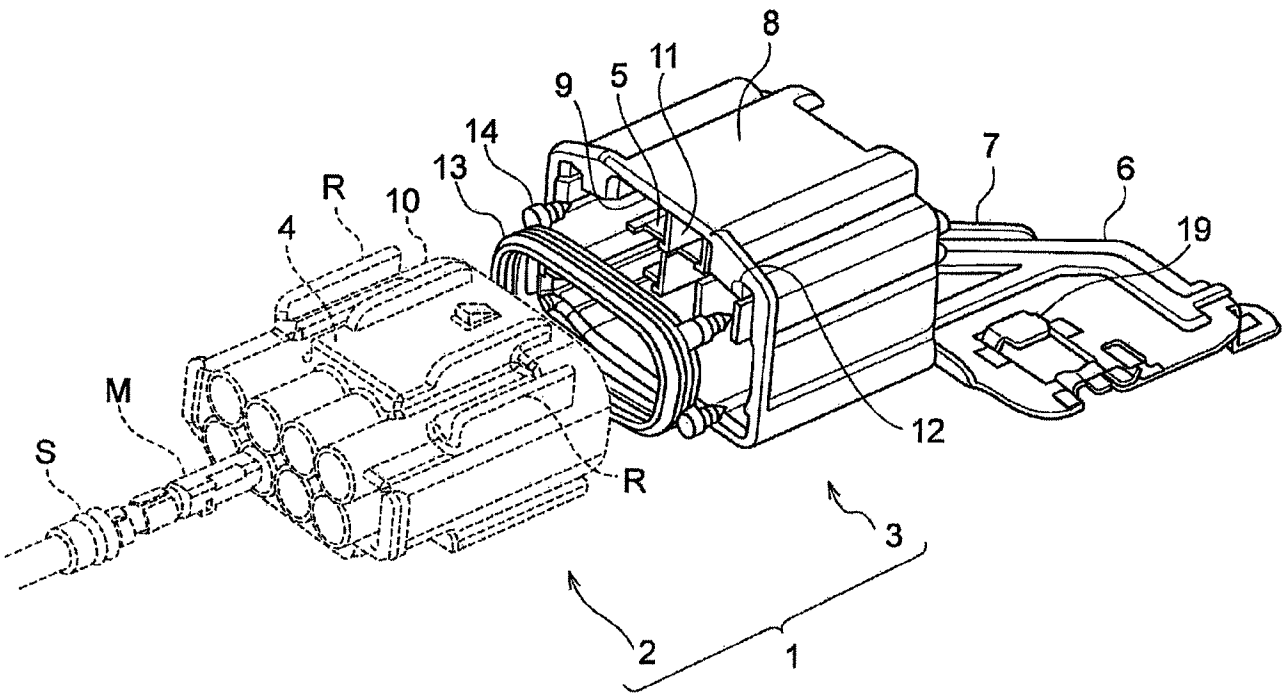
FIG. 1 is a perspective view illustrating the configuration of a waterproof earth joint connector to which an embodiment of the invention is applied.

Hereinafter, referring to the drawings, an embodiment will be described in which a waterproof connector of the invention is applied to a waterproof earth joint connector which is installed in a vehicle. The waterproof earth joint connector is used when ends of a plurality of electric wires are commonly connected to an earth conductor such as a vehicle body. However, the application of the waterproof connector of the invention is not limited to the waterproof earth joint connector, and hence, the waterproof connector of the invention can also be applied to a normal connector in which a female connector and a male connector are fitted together or a simple joint connector.

FIG. 1 is a perspective view illustrating the configuration of a waterproof earth joint connector of this embodiment. The waterproof earth joint connector 1 is configured of a combination of a female connector 2 and a male connector 3. The female connector 2 has a plurality of female terminals M and a resin female housing 4 which accommodates and holds these female terminals M. The male connector 3 has a conductor 7 which is formed by connecting continuously a plurality of male terminals 5 and a bus bar 6 and a resin male housing 8 in which the conductor 7 is insert molded. Hereinafter, the male connector 3 will be described mainly which corresponds to the waterproof connector of the invention.

A space portion 9 is formed in the male housing 8 so as to open towards the female housing 4. This space portion 9 is formed to have a cross-sectional shape which matches an outer circumferential surface of a hood portion 10 of the female housing 4, so that the hood portion 10 is fitted in to the space portion 9. The plurality of male terminals 5, which are inserted into the corresponding female terminals M for connection, are accommodated and held in the space portion 9. The male terminals 5 are separated individually from one another by partition walls 11 and are formed so as to slide into the corresponding female terminals M at distal ends thereof for connection. The male terminals 5 are connected individually to an earth conductor of a vehicle body via the bus bar 6 to thereby make an earth circuit.

Fitting grooves 12 into which parts of an outer wall of the hood portion 10 are fitted are provided on an inner wall of the space portion 9 so that ribs R of the hood portion 10 are inserted into the corresponding fitting grooves 12 when the hood portion 10 is fitted in the space portion 9. An annular waterproof packing 13 is mounted on a bottom wall of the space portion 9 which faces an opening at a deeper side of the space portion 9 so as to surround the male terminals 5. When the hood portion 10 is fitted into the space portion 9, the waterproof packing 13 is held between the hood portion 10 and the inner wall of the space portion 9, so that a gap between the male housing 8 and the female housing 4 is sealed up. A plurality of pillar-shaped projecting portions 14 are provided on the waterproof packing 13 so as to extend in a fitting direction of the connectors 2 and 3, so that the waterproof packing 13 is held to the male housing 8 by these projecting portions 14 being inserted into holes, not shown, in the bottom wall the space portion 9. The plurality of female terminals M to which electric wires are connected are held in the female housing 4, and a gap between the female housing 4 and each electric wire is sealed up with a waterproof plug S so as to prevent the intrusion of water into the female housing 4.

Figure 2:
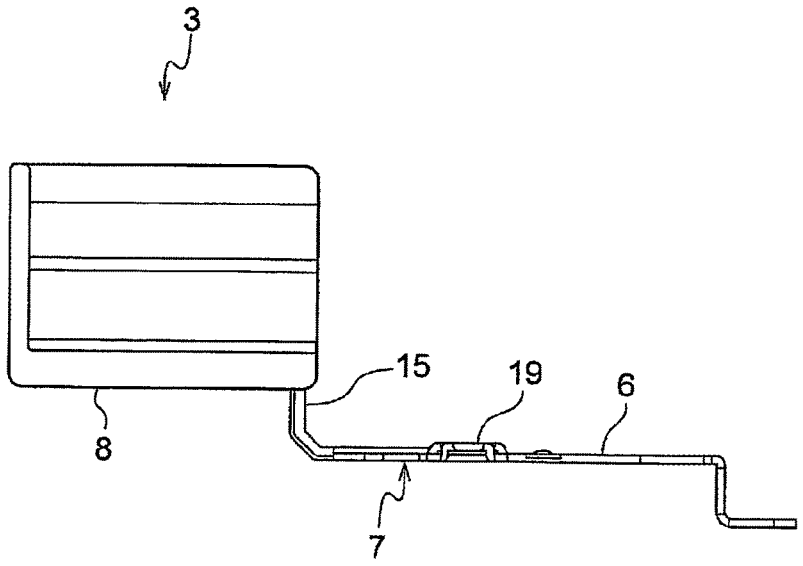
FIG. 2 is a side view of a male connector which configures the waterproof earth joint connector illustrated in FIG. 1.

The conductor 7 is formed by punching a metallic plate material and bending the resulting metallic plate. As illustrated in FIGS. 2 to 3B, the conductor 7 has the plurality of male terminals 5 which are formed at one end side, the bus bar 6 which is formed at the other end side and a fixing portion 15 which is connected continuously to the male terminals 5 and the bus bar 6.

Figure 3A:
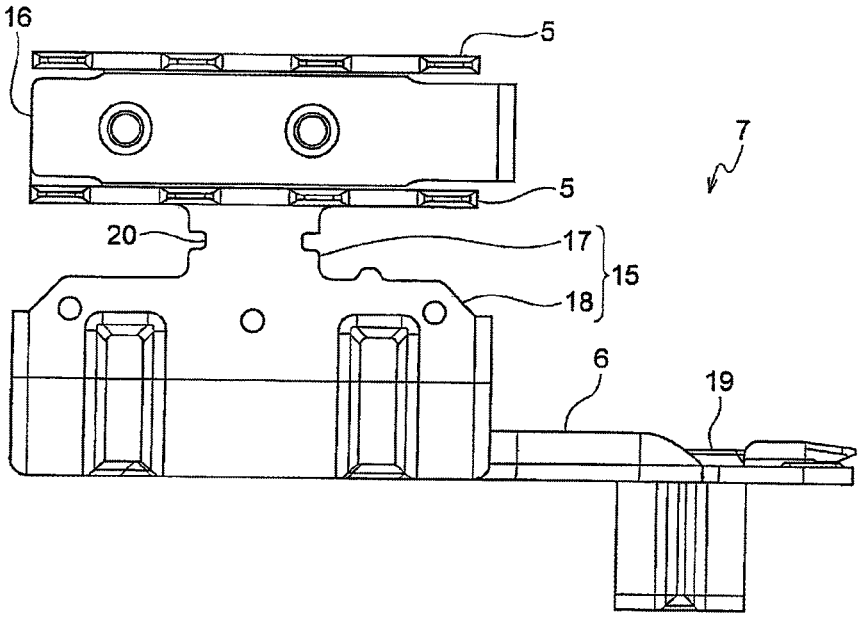
FIGS. 3A and 3B illustrate front views of a conductor which is insert molded in a male housing of the male connector.
Figure 3B:
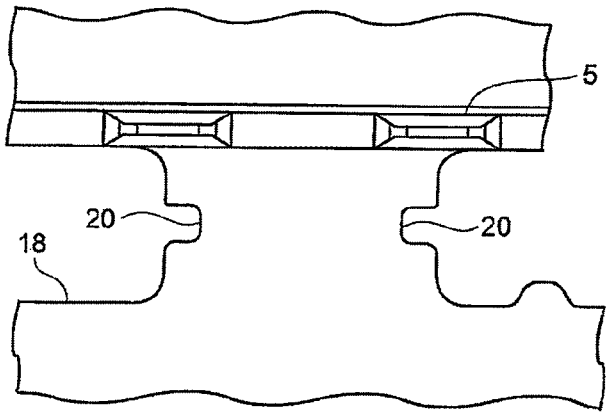

As illustrated in FIG. 3A, the male terminals 5 are arranged individually along a pair of facing sides of a base plate 16 which has a rectangular shape and are then bent so as to rise towards a front side of a sheet on which FIG. 3A is drawn. In this embodiment, the male terminals 5 are formed integrally with the base plate 16 and are bent to rise from both side edges of the base plate 16. However, the male terminals 5 can be formed separately from the base plate 16 and can then be connected to the base plate 16 through welding, for example.

The fixing portion 15 is provided so as to extend in a direction substantially perpendicular to an extending direction of the male terminals 5 and is formed by connecting a first connecting portion 17 having a relatively short width dimension (in a left-to-right direction in FIGS. 3A and 3B) and a second fixing portion 18 having a relatively long width dimension.

The bus bar 6 is bent to an opposite side to a rising direction of the male terminals 5 with respect to the fixing portion 15 and is formed into a flat plate shape, being fixed in place in a predetermined position on the vehicle body. A connecting portion 19 with which an earth terminal is to be connected is provided on the bus bar 6.

The conductor 7 which is configured in the way described above is insert molded in the male housing 8, and the fixing portion 15 (at least the first fixing portion 17) is embedded in a cylindrical wall of the male housing 8, whereby in the conductor 7, the male terminals 5 and the bus bar 6 are supported on the male housing 8 in a cantilever-like fashion.

Incidentally, resin shrinks in the male housing 8 after the male housing 8 is resin molded, whereby the overall volume of the male housing 8 is reduced. Additionally, the volume of the conductor 7, which is thermally expanded to increase its volume by being heated when it is formed, is also reduced after it has been formed. However, a volume reduction rate of the male housing 8 is greater than a volume reduction rate of the conductor 7, and therefore, there may be a situation in which in the male connector 3, a minute gap is produced between the conductor 7 and the male housing 8 due to difference in volume reduction rate between the conductor 7 and the male housing 8. In this respect, in this embodiment, a sealing agent is interposed between the conductor 7 and the male housing 8 so as to surround the conductor 7 in a circumferential direction along the minute gap to thereby ensure a required sealing performance.

Here, a characteristic configuration of the embodiment will be described. As illustrated in FIGS. 3A and 3B, in the fixing portion 15 of the conductor 7, a notched portion 20 is provided on each side of the first fixing portion 17 in a width direction thereof. The notched portions 20 are formed on planes which include a pair of facing sides in a thickness direction of a rectangular cross section of the first fixing portion 17 perpendicular to the extending direction of the conductor 7. The notched portions 20 are each provided in the form of a groove which extends from one end face to the other end face of the first fixing portion 17 in the thickness direction and formed so as to have a rectangular cross section. Although the notched portions 20 extend in a direction perpendicular to the extending direction of the conductor 7, the notched portions 20 can be provided so as to be inclined at other angles. The conductor 7 is insert molded so that at least the notched portions 20 of the first fixing portion 17 are embedded completely in the male housing 8.

Next, a fabricating method of the male connector 3 will be described. A sealing agent is applied to the conductor 7 in a stage prior to molding. A sealing agent used has such characteristics that the sealing agent takes the form of liquid, for example, at a point in time when it is applied to the conductor 7 and is then solidified when the sealing agent is dried. In this embodiment, the conductor 7 on which the sealing agent applied to the surface thereof is dried to be solidified completely is insert molded. The sealing agent is applied to at least the portion which is embedded in the male housing 8 or, specifically speaking, to a full circumference of the first fixing portion 17 which includes the notched portions 20, as a result of which the sealing agent not only adheres to the surface of the conductor 7 by surface tension but also is retained inside the notched portions 20.

Figure 4A:
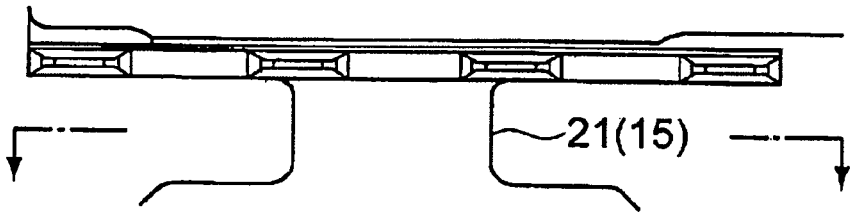
FIG. 4A Related Art

Here, referring to FIGS. 4A to 5B, adhering conditions of the sealing agent to a conductor 21 before molding on which no notched portion 20 is formed and to the conductor 7 on which the notched portions 20 are formed will be described while comparing them to each other. FIGS. 4A and 5A are partial enlarged views of the fixing portion 15, and FIGS. 4B and 5B are sectional views of the fixing portion 15 taken along a line and seen as indicated by arrows in FIGS. 4A and 5A.

Figure 4B:
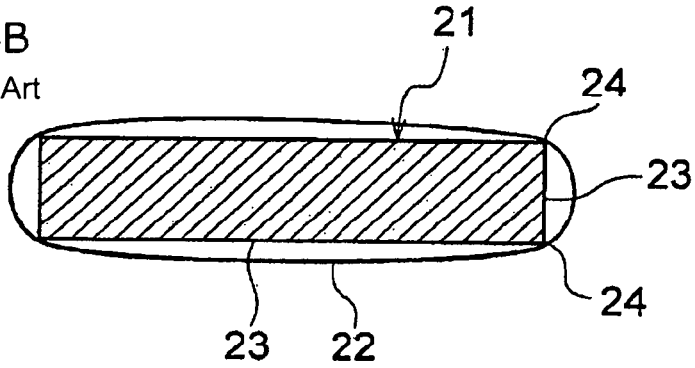
FIG. 4B Related Art
Figure 5A:
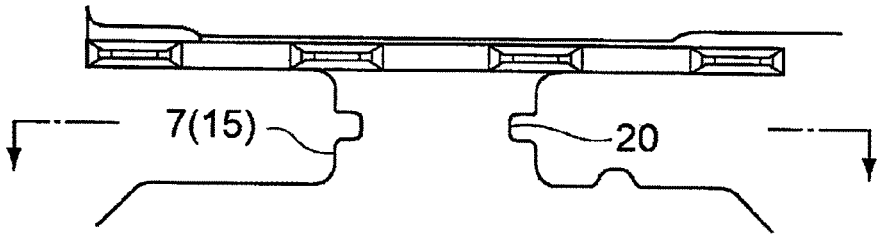

As illustrated in FIGS. 4A and 4B, in the case of the conductor 21 on which no notched portion 20 is formed, the sealing agent adheres to planes which include sides 23 of the cross section while heaping into an arc-like shape by surface tension, however, almost no sealing agent 22 adheres to four corner portions 24. Consequently, there are produced gaps where no sealing agent 22 is interposed between the corner portions 24 of the fixing portion 15 and the male housing 8 after the conductor 21 is insert molded.

Figure 5B:
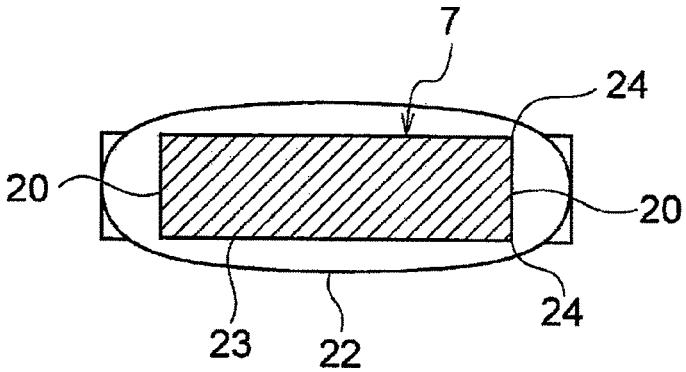
Figure 6:
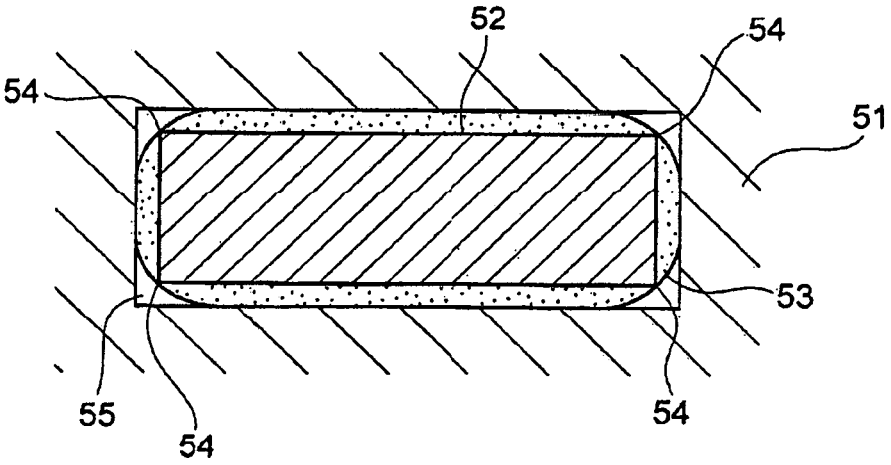
FIG. 6 Related Art
FIG. 6 is a view illustrating a gap between the conductor and the male housing when the related-art conductor is used.

On the other hand, as illustrated in FIGS. 5A and 5B, in the case of the conductor 7 on which the notched portions 20 are formed, the sealing agent 22 applied to the conductor 7 adheres to planes which include sides 23 of the cross section and is retained in each of the two notched portions 20 by surface tension. This increases the adhering amount of the sealing agent 22 per unit area on the surface of the fixing portion 15, and therefore, the sealing agent 22 can adhere to surfaces of corner portions 24 which are situated at both ends of each of the notched portions 20 in an ensured fashion. Additionally, as illustrated in FIG. 5B, a state where the sealing agent 22 adheres to the surface of the fixing portion 15 which includes the corner portions 24 is maintained at a point in time when the sealing agent 22 is completely solidified after being dried. Namely, the sealing agent 22 is formed circumferentially so as to surround an external surface of the fixing portion 15 which includes the notched portions 20. Consequently, the conductor 7 on which the sealing agent 22 has solidified is insert molded in the male housing 8, whereby an area where the sealing agent 22 is interposed uniformly is formed in a gap between the external surface of the fixing portion 15 which includes the corner portions 24 and the male housing 8, thereby making it possible to enhance the sealing performance of sealing the gap between the conductor 7 and the male housing 8.

Thus, as has been described heretofore, in this embodiment, since the notched portions 20 are formed on the conductor 7, the sealing agent 22 which is retained in the notched portions 20 can be allowed to remain at the corner portions 24 even after the sealing agent 22 has solidified. Consequently, the gaps between the corner portions 24 and the male housing 3 can be closed in an ensured fashion, thereby making it possible to prevent the intrusion of water into the male housing 8.

Additionally, in the embodiment, since the notched portions 20 are each formed into the groove which reaches the corner portions 24 of the conductor 7, even after the sealing agent 22 has solidified, the sealing agent 22 which is retained in the notched portions 20 can be prevented from spreading, whereby the sealing agent 22 is allowed to remain to the corner portions 24 along the notched portions 20. This allows the thickness of the sealing agent 22 which adheres to the corner portions 24 to be secured to a set amount.

In this embodiment, the notched portions 20 are described as being formed on the planes which include the pair of facing side in the thickness direction of the cross section of the first fixing portion 17 perpendicular to the extending direction of the conductor 7. However, the notched portions 20 may be formed on planes which include a pair of facing sides in a width direction of the cross section or may be formed on planes which include all the sides of the cross section so as to surround the first fixing portion 17. In particular, in case the notched portion 20 is formed so as to surround the first fixing portion 17, the overall length of the notched portion 20 becomes long, whereby more sealing agent can be allowed to stay on the surface of the conductor 7, which can increase the thickness of the sealing agent, thereby making it possible to enhance more the waterproofness of the male housing 8.

In the case of the connector structure of this embodiment, only by insert molding to the housing 8 the conductor 7 to which the sealing agent is applied in advance, the gap between the conductor 7 and the housing 8 can be sealed up. Therefore, for example, although the facility where the connector on which the insert molding is completed is impregnated with the sealing agent is used in Patent Literature 1 described above, this sealing agent impregnating facility becomes unnecessary, and the post washing process of washing connectors also becomes unnecessary. Consequently, according to the embodiment, the facility costs and the fabrication costs can be suppressed, and therefore, the economic advantage becomes great.

Thus, while the embodiment of the invention has been described in detail by reference to the drawings, the embodiment described only illustrates the invention, and hence, the embodiment can be altered or modified variously without departing from the scope of claims to be made later.

For example, in the embodiment, in the male connector 3, although a part of the conductor 7 is described as being embedded in the cylindrical wall of the male housing 8, in short, the portion of the conductor 7 where the notched portions 20 are formed should be embedded in any portion of the male housing 8. For example, the conductor 7 may be embedded in a bottom wall of the male housing 8.

Additionally, in the embodiment, although the cross section of the notched portion 20 is described as having the rectangular shape, the shape of the cross section is not limited to the rectangular and hence can be formed, for example, into an arc-like shape or a triangular shape. However, since the rectangular cross section can retain more sealing agent than cross sections of other shapes, the rectangular cross section constitutes the most preferable cross section.

In this embodiment, the notched portions 20 are described as being formed into the groove which extends between the ends of the conductor 7 in the thickness direction, the notched portions are not limited to that configuration. Namely, the notched portions should be formed into a recess portion (a depression) which can retain therein the sealing agent applied to the conductor 7, and hence, the notched portions can be formed in positions lying apart from the corner portions 24 of the conductor 7. Even in the event that this configuration is adopted, when the sealing agent is retained in the recess portion, the adhering amount of sealing agent per unit area on the surface of the fixing portion 15 is increased, and therefore, the sealing agent is allowed to adhere to the surfaces of the corner portions 24. However, the recess portions are preferably provided near the corner portions of the conductor 7.

What is claimed is:

1. A waterproof connector comprising:

a resin housing;

a conductor extended from the resin housing, and the conductor including a recess portion provided at a portion of the conductor embedded in the resin housing; and a sealing agent interposed in a gap between the recess portion of the conductor and the resin housing, wherein:

a cross-section of the conductor at the recess portion is in a rectangular shape, the cross-section being perpendicular to an extending direction of the conductor, the extending direction of the conductor being perpendicular to a thickness direction of the conductor and the recess portion includes a notch extending in a direction perpendicular to the thickness direction of the conductor.

2. The water proof connector according to claim 1, wherein the notch is provided in a plane including at least one side of the cross section.

3. The waterproof connector according to claim 1, wherein the conductor includes one end portion in an interior of the resin housing, the other end portion which is in an exterior of the resin housing and to be fixed to an exterior portion, and a fixing portion which is connected to the one end portion and the other end portion and is embedded in the resin housing, and the recess portion is formed in the fixing portion.

4. The water proof connector according to claim 1, wherein the notch extends through the conductor in the thickness direction thereby forming the notch extending in the direction perpendicular to the thickness direction.

5. The water proof connector according to claim 1, wherein the conductor further comprises a plurality of male terminals extending in a direction perpendicular from the extending direction of the conductor at the recess portion and extending in a direction perpendicular from the direction perpendicular to the thickness direction of the conductor.

6. The water proof connector according to claim 5, wherein each of the plurality of metal terminals extends in a direction parallel with the thickness direction of the conductor at the recess portion.

7. A fabrication method of a waterproof connector, the method comprising:

providing a resin housing providing a conductor including a fixing portion to be embedded in the resin housing;

applying a sealing agent to the conductor at the fixing portion to be embedded in the resin housing, the fixing portion having a recess portion; and insert molding the conductor in the resin housing after the sealing agent has solidified, wherein:

a cross-section of the conductor at the recess portion is in a rectangular shape the cross-section being perpendicular to an extending direction of the conductor, the extending direction of the conductor being perpendicular to a thickness direction of the conductor and the recess portion includes a notch extending in a direction perpendicular to the thickness direction of the conductor.

8. The method according to claim 7, wherein the notch extends through the conductor in the thickness direction thereby forming the notch extending in the direction perpendicular to the thickness direction.

9. The method according to claim 7, wherein the conductor further comprises a plurality of male terminals extending in a direction perpendicular from the extending direction of the conductor at the recess portion and extending in a direction perpendicular from the direction perpendicular to the thickness direction of the conductor.

10. The method according to claim 9, wherein each of the plurality of metal terminals extends in a direction parallel with the thickness direction of the conductor at the recess portion.

* * * * *